US005308190A

United States Patent [19]

Raymond

[11] Patent Number: 5,308,190

[45] Date of Patent: May 3, 1994

[54] METHOD AND APPARATUS FOR HEATING AN ASPHALT PAVING SCREED

[75] Inventor: Larry Raymond, Tacoma, Wash.

[73] Assignee: Carlson Paving Products, Inc., Tacoma, Wash.

[21] Appl. No.: 136,330

[22] Filed: Oct. 13, 1993

Related U.S. Application Data

[63] Continuation-in-part of Ser. No. 847,648, Mar. 3, 1992, Pat. No. 5,259,693, which is a continuation-in-part of Ser. No. 577,615, Sep. 4, 1990, Pat. No. 5,096,331.

[51] Int. Cl.[5] ..... E01C 23/14; E01C 19/22

[52] U.S. Cl. ..... 404/95; 404/118

[58] Field of Search ..... 404/91-92, 404/95-96, 114, 118; 62/23; 426/388, 453; 165/35, 104.19, 108; 432/36-37, 47

[56] References Cited

U.S. PATENT DOCUMENTS

| | | | |
|---|---|---|---|
| 3,557,672 | 1/1971 | Shurtz | 404/95 |
| 3,864,858 | 2/1975 | Rochfort | 404/98 |
| 3,997,276 | 12/1976 | Jackson, Sr. | 404/95 X |
| 4,018,540 | 4/1977 | Jackson, Sr. | 404/95 |
| 4,072,435 | 2/1978 | Coho et al. | 404/92 X |
| 4,319,856 | 3/1982 | Jeppson | 404/95 X |
| 4,379,653 | 4/1983 | Brown | 404/118 |
| 4,714,374 | 12/1987 | Mihara | 404/91 |
| 4,944,631 | 7/1990 | Egli | 404/91 |

*Primary Examiner*—Kenneth J. Dorner
*Assistant Examiner*—Nancy Mulcare
*Attorney, Agent, or Firm*—Seed and Berry

[57] ABSTRACT

Heat exchange tubes are mounted on the upper face of the sole plates of the main screed and screed extenders on an asphalt paving machine. Hot oil is circulated through the heat exchange tubes to preheat the sole plates. The heating system for the oil includes a heat exchanger in the exhaust system of the internal combustion engine for driving the tractor of the paving machine. The heating oil is pressurized by a pump driven by a hydraulic motor supplied with pressurized oil in a second hydraulic circuit from a pump driven by the engine. This second circuit is also used to operated the vibratory mechanisms on the screeds.

13 Claims, 5 Drawing Sheets

ASPHALT PAVING MACHINE

METHOD AND APPARATUS FOR HEATING AN ASPHALT PAVING SCREED

This application is a continuation-in-part of U.S. patent application Ser. No. 07/847,648 filed Mar. 3, 1992, now U.S. Pat. No. 5,259,693, as a continuation-in-part of U.S. patent application Ser. No. 07/577,615 dated Sep. 4, 1990, now U.S. Pat. No. 5,096,331.

TECHNICAL FIELD

The present invention relates to asphalt paving machines, and particularly to means for preheating primary screed sections and screed extenders.

BACKGROUND OF THE INVENTION

The sole plates of screeds on asphalt paving machines must be preheated to about 175° F. to 200° F. before paving commences to keep the hot asphalt from congealing on the sole face of the screeds. Prior to my inventions identified above, the preheating has been accomplished by oil or propane burners mounted on the moldboard and directly heating the top surface of the screeds. When using such burners, particular care must be taken to avoid overheating since this can result in permanent warping of the screed.

My prior invention provided an improved preheating system applicable to both primary and extension screeds which eliminated the use of oil or propane burners by utilizing the heat created by dropping the pressure of high pressure oil at a flow restrictor. In the case of extender screeds, a reservoir was initially mounted in direct contact with the top surface of each screed, and oil from the reservoir was pressurized by a pump and circulated through a flow restrictor to create a large pressure drop. This pressure drop is adjusted to result in an output oil temperature of about 275° F. which normally is sufficient to establish the desired screed temperature of about 200° F.

In the case of the primary screed, instead of providing a reservoir on the top of the screed, my previous invention provided flat-sided heat exchange tubes attached directly to the upper surface of the screed through which the heated oil is circulated. This arrangement reduces the amount of oil required in the system.

In the preferred operation of my previous invention directed particularly at heating a primary screed for an asphalt paver having a primary floating screed equipped with screed extensions and towed by a tractor, a hydraulic pump on the tractor supplies pressurized oil to a control unit on the primary screed from which the oil is selectively distributed to drive hydraulic motors in the heating and vibratory systems for the screeds. The hydraulic motor in the heating system drives a high pressure pump whose output is circulated in a closed independent system through a flow restriction causing the circulating oil to be heated responsive to the resulting pressure drop. Heated oil is circulated through heat exchange tubes mounted on the sole plate of the primary screed and returns to a small reservoir tank from which the high pressure pump takes its suction. Heated oil is also circulated through head exchange tubes on the sole plates of the extender screeds or through shallow tanks on the sole plates. One or more temperature sensors are is provided in the heating system to detect overheating of the components and cause most of the oil supplied to the hydraulic motor or motors in the heating system to be cut off in the control manifold when an overheating condition is sensed. After being utilized to heat the screeds, the pressurized oil from the tractor is diverted at the control manifold to hydraulic motors in the vibratory system which drive eccentric carrying shafts mounted on the screed units.

SUMMARY OF THE INVENTION

The present invention utilizes the exhaust system of the engine on the paver tractor as the heat source for heating circulated in heat exchange relationship to the sole plates of the screeds. In this arrangement the oil is circulated at low pressure by a pump taking suction from a reservoir which is connected to one end of a coiled heat exchange tube in the exhaust system. The other end of the heat exchange tube is connected to the discharge end of the heat exchangers on the sole plates.

DETAILED DESCRIPTION OF THE INVENTION

Figure 4:
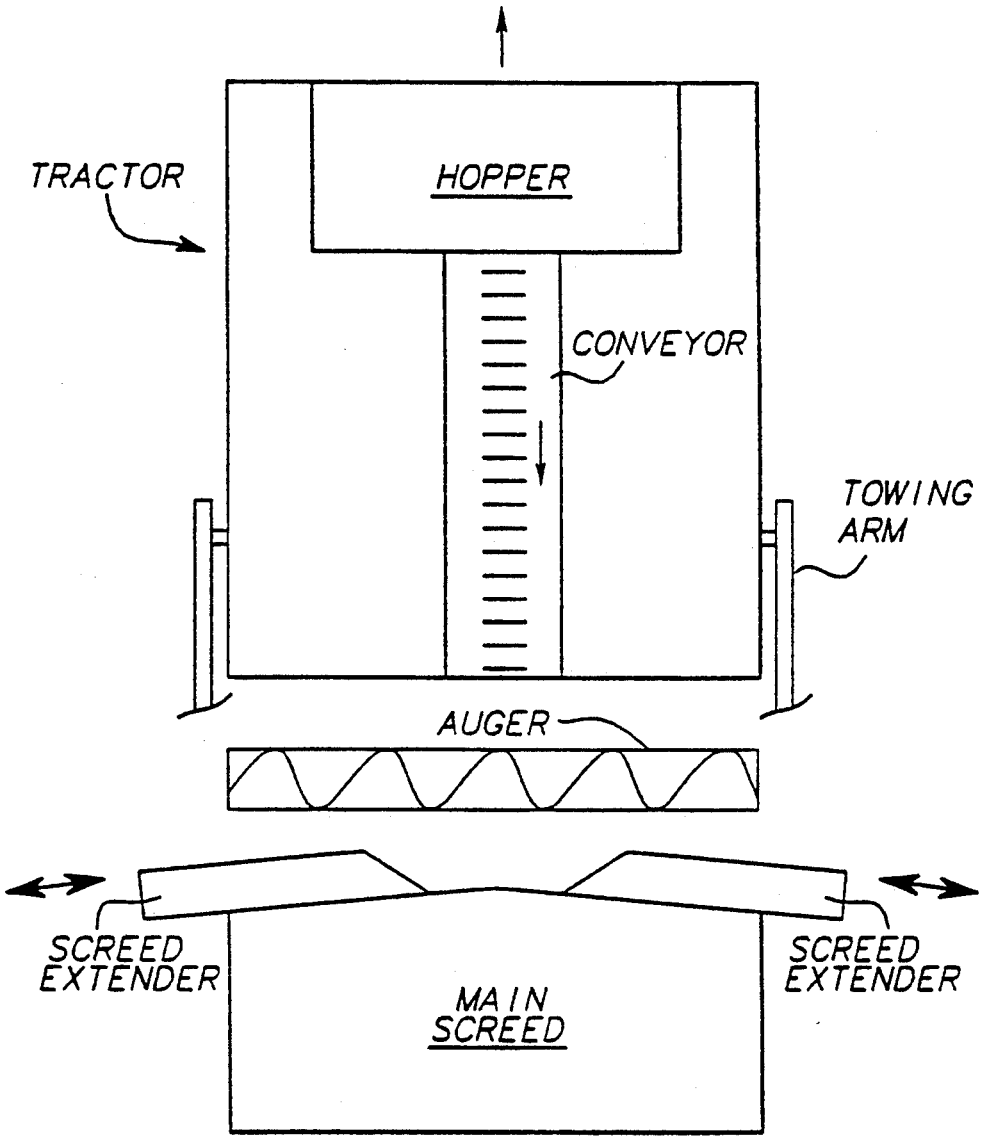
FIG. 4 is a schematic plan view of an asphalt paving machine.
Figure 5:
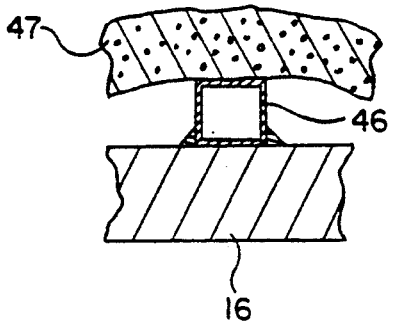
FIG. 5 is an enlarged detail sectional view taken as indicated by line 5—5 in FIG. 3.

The general layout of an asphalt paving machine with a floating main screed equipped with adjustable screed extenders which is towed by a tractor is shown in FIG. 4. Hot asphalt paving material is fed by one or two conveyers from a front hopper on the tractor to an auger carried by the tractor between the tractor and the main screed.

The main screed unit has a pair of side-by-side frame sections 10, 11 each comprising an outer generally triangular side plate 12, an inner gusset plate 13, a deck plate 14, and a front moldboard 15. Each deck plate 14 has an upturned front flange **14*a* which is partly overlapped by the respective moldboard 15, and each moldboard has a rearwardly extending top flange 15*a* which overlaps a flat upper edge portion of the respective side plate 12. The side plates 12 and gusset plates 13 are welded in position to the deck plates 14 and moldboards 15 and the moldboards are welded to the front flange 14*a* of the deck plates 14. Near the rear each deck plate 14 bends downwardly and has a back lip 14*b*** which has a gentle upward slope.

Figure 3:
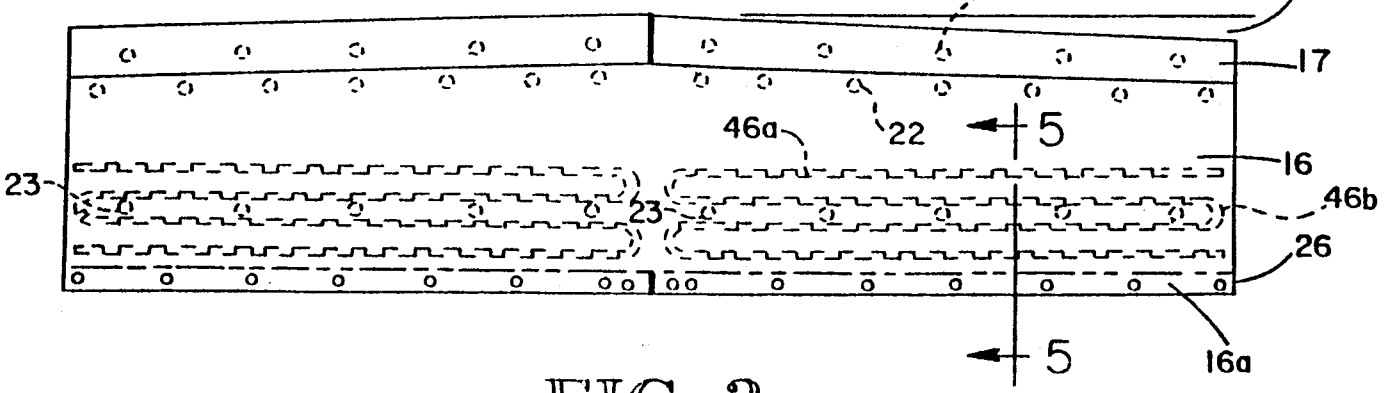
FIG. 3 is a bottom plan view of the screed unit.

The main screed unit also has a sole plate 16 and a pair of side-by-side front bullnose members 17 bent from plate stock. The front edge of the sole plate is tapered laterally in both directions from the center so as to slope rearwardly toward both sides of the screed unit as best seen in FIG. 3. Hence, the front edge of the sole plate has a convex V-shape. This convex V-shape is matched by the back edges of the bullnose members 17 which together provide a concave V-shape. The bullnose sections 17 extend from the sole plate 16 forwardly a short distance by bottom flanges 17*a* and then have a rounded nose portion 17*b* which joins an upturned flange 17*c* which overlaps the respective deck plate flange 14*a* below the respective moldboard element. The front taper angle 19 (FIG. 3) of the screed is preferably about three to five degrees, for example.

Figure 1:
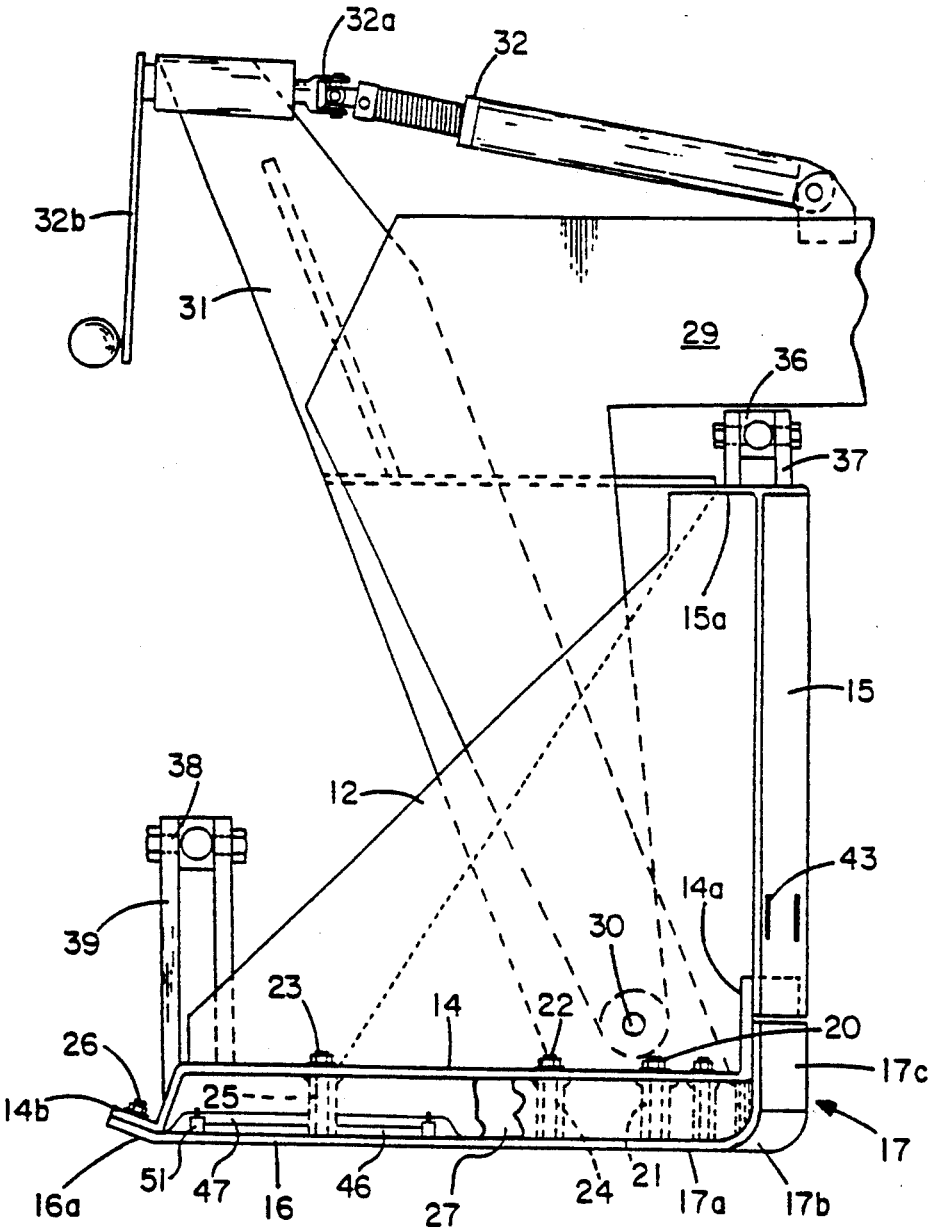
FIG. 1 is an end view of a main screed unit on the paving machine embodying the present invention.

The bullnose members 17 are held in position by a row of studs 20 which are anchored to the sole plate 16 and pass through tubular spacers 21 seated between the bottom flanges 17*a* of the bullnose members 17 and the deck plate 14. Nuts on the studs 20 seat against the upper face of the deck plate 14. Similarly, the sole plate 16 is held in position by front and intermediate rows of studs 22, 23 and respective spacers 24, 25 and by rear bolts 26 which connect the back lip 14*b* on the deck plates to a matching lip 16*a* sloping upwardly at the rear of the sole plate 16. The space between the sole plate 16 and the deck plate 14 is closed by end covers 27 shown fragmentarily in FIG. 1.

The screed unit is towed from a tractor by a pair of laterally spaced drag arms 29 of general L-shape which are pivotally connected to the tractor adjacent their forward ends and are pivotally connected to the screed unit by pins 30 extending through the side plates 12 and a pair of upstanding lever arms 31 which are welded at their lower ends to the deck plates 14. Jack screws 32 with universals 32*a* and operating handles 32*b* connect the upper ends of the lever arms 31 to the drag arms 29 so that the lever arms can be pulled forwardly or pushed rearwardly relative to the drag arms 29 to thereby adjust the plane of the sole plate 16 relative to the ground surface to vary the vertical attack angle of the screed. Under normal operating conditions the sole plate 16 is tipped upwardly slightly at the front for a positive angle of attack.

Figure 2:
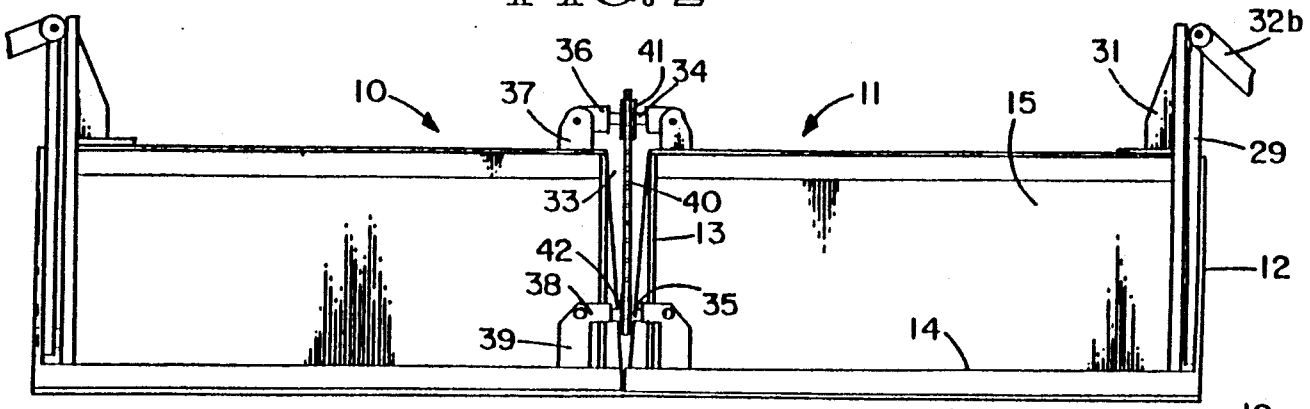
FIG. 2 is a rear elevational view of the screed unit.

It will be noted from FIG. 2 that the opposed inner edges of the moldboard members 15 and the opposed inner edges of the upturned flanges 17*c* and rounded nose portions 17*b* of the bullnose members 17 diverge from the plane of the bottom face of the sole plate 16 to form a V-shaped gap 33. This gap is provided to permit downward dishing of the sole plate 16 to be performed as will now be explained.

Adjustment is provided for raising or lowering the center of the sole plate 16 relative to the lateral sides so that the sole plate can be dished upwardly to conform with a crown in the road, or can be dished downwardly to provide a valley to serve as drain area for a parking lot, for example. This adjustment is accomplished by operation of front and back laterally extending jack screws 34, 35. The front jack screw extends to two nuts 36 mounted between two pairs of ears 37 anchored to the two moldboard members 15, and the back jack screw 35 extends to two nuts 38 mounted between two other pairs of ears 39 anchored to the deck plates 14. These two jack screws 34, 35 can be operated in unison by way of a chain 40 extending around sprockets 41, 42 mounted on the jack screws. The chain 40 can be driven by a reversible motor (not shown), or a second motor driven sprocket can be provided for the front jack screw 34.

Each jack screw 34, 35 has threaded end portions of opposite hand which screw into the respective nuts 36, 38. Hence, when the jack screws 34, 35 are turned in unison responsive to driving of the chain 40, the two frame sections 10, 11 are pulled toward one another or pushed apart depending on the selected direction of rotation of the jack screws, thereby responsively dishing the sole plate 16 downwardly or upwardly.

It has been found to be advantageous under normal highway paving conditions to dish the sole plate 16 upwardly more at the front than at the rear. This is accomplished by initially preloading the front of the sole plate by manually turning the forward jack screw 34 to extend the distance between the nuts 36 with the chain 40 disconnected. This preloading is maintained when the chain 40 is reconnected.

As indicated in FIG. 4, screed extenders may be mounted at the front of the main screed unit behind the auger in the manner disclosed in U.S. Pat. No. 4,818,140. The extenders are slide supported on the moldboard members 15 and ride near the bottom along guide plates (not shown) which are bolted in position covering a lower portion of the front face of the moldboard members and most of the front face of the upturned bullnose flanges 17*c*. Slots 43 are provided in the moldboard members 15 to receive the bolts for mounting the guide plates for the screed extenders.

The sole plate 16 of the main screed is provided with two sets of heat exchange tubes 46, one for each half, covered with insulating blankets 47. The tubes 46 are preferably rectangular in cross-section so as to rest flat against the upper face of the sole plate. For example, the tubes may be mild steel square tubing 0.5 inch wide on each outer face and having a wall thickness of 0.0625 inch. The heat exchange tubes are spot welded on each half of the sole plate 16 at regular intervals in position to form a respective serpentine path (FIG. 3) having straight parallel sections 46*a* extending lengthwise of the screed which are joined by carved end sections 46*b*. In the case of a typical main screed having a sole plate 10 feet long and about 26 inches wide, the straight sections of the tubing may be spaced about 3.5 inches apart and be located in about the back 15 inches of width of the sole plate where most of the preheating is needed.

Figure 6:
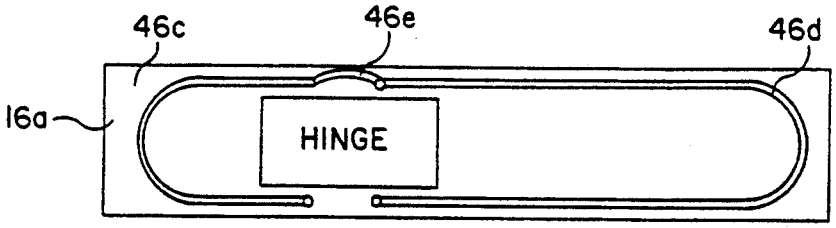
FIG. 6 is a plan view illustrating the layout of the heat exchange tubes on the sole plate of a screed extender.

Like tubing is also mounted on the upper face of the sole plates on the extension screeds as indicated in FIG. 6. A typical sole plate 16*a* for an extension screed may have a width of about 8 inches and a length of about 44 inches. If, as indicated in FIG. 6, the sole plate is articulated for berm formation and has hinge assembly such as shown in U.S. Pat. No. 4,818,140, it is preferred to provide single loops of tubing 46*c*, 46*d*, on the sole plate sections and to interconnect the loops by a flexible hose 46*e* which loops horizontally around the hinge assembly. One of the loops 46*c*, 46*d* is connected by a flexible supply hose 48 to one end of the heat exchange tubing 46 on the adjoining half of the main screed, and the other end is connected to a flexible return hose 49. The tube exchange tubing 46—46 on the main screed is supplied via branches 50*a*–50*b* from a supply line 50. Right-angle nipple fittings 51 are fixed to the ends of the heat exchange tubing on the sole plates to present upstanding nipples to receive swivel socket connections on the related hoses.

Figure 7:
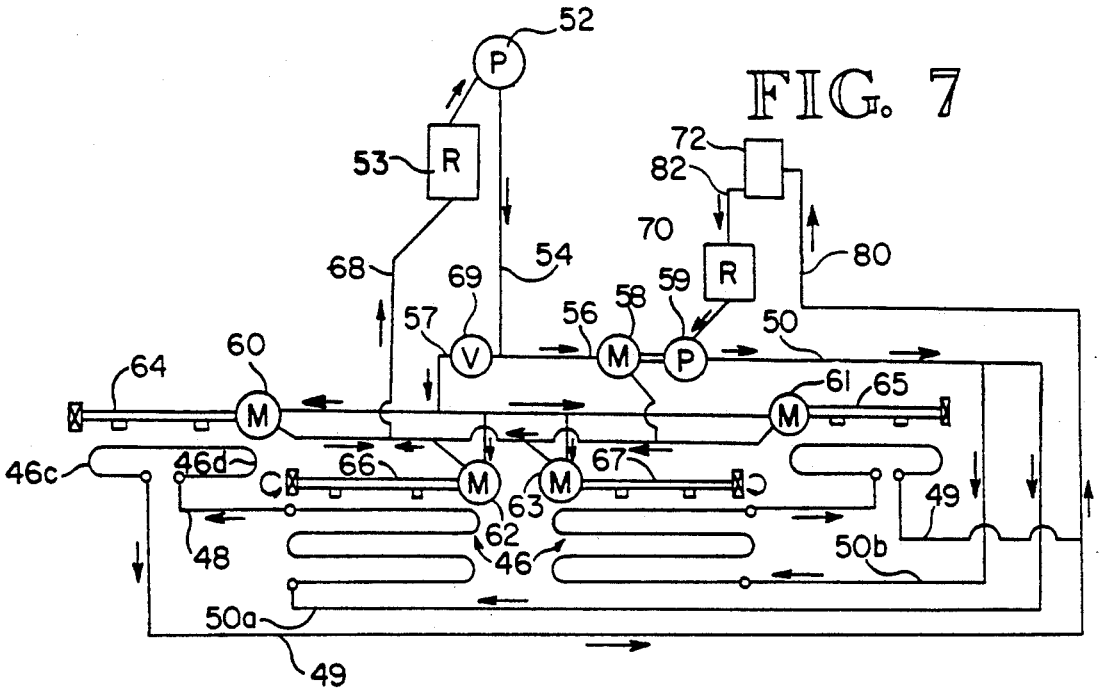
FIG. 7 is a schematic of a hydraulic system for the main screed and screed extenders utilizing the present invention.

Directing attention to FIG. 7, the tractor for an asphalt paver normally has a hydraulic pump 52 for power take-off which is usually driven off the tractor engine and is supplied with oil from a reservoir 53 on the tractor. In accordance with the present invention the output from the pump 52 is connected by a hose 54 to a T-fitting from which two branch lines 56–57 extend. Branch 56 supplies a hydraulic motor 58 driving an oil circulation pump 59 which feeds heated oil via supply line 50 to the heat exchange tubes 46 on the main screed. Branch 57 feeds four hydraulic motors 60–63. Motors 60–61 drive vibratory units 64–65 on the screed extenders and motors 62–63 drive vibratory units 66–67 on the main screed. The vibratory units 64–65 and 66–67 conventionally comprise rotary shafts carrying eccentrics. The five hydraulic motors 58, 60, 61, 62 and 63 have return lines which connect to a return hose 68 discharging into the reservoir 53. A shut-off valve 69 may be provided in the branch line 57 to delay operation of the vibratory units while the screeds are being initially heated.

Figure 8:
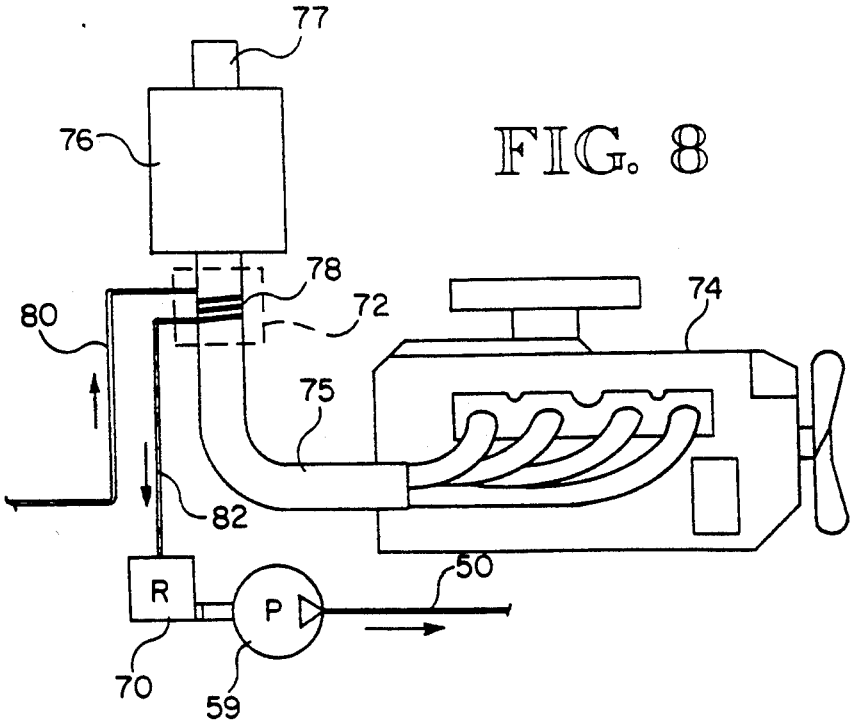
FIG. 8 is a schematic of the heat exchanger arrangement in the exhaust system of the paver engine.

The circulation pump 59 operates in a range of about 50 to 100 psi and takes suction from a reservoir 70 which can be a small vented tank fed from a heat exchanger 72 preferably located at a higher elevation. As indicated in FIG. 8, the heat exchanger 72 is located in the exhaust system of the internal combustion engine 74 used to drive the tractor of the asphalt paver. The exhaust pipe 75 from the engine 74 discharges via a muffler 76 and tailpipe 77, and has a heat exchanger coil 78 wound therearound. This coil 78 is fed by a return line 80 which feeds from the return hoses 49—49 leading from the heat exchange loops **46*c* on the sole plates of the extender screeds. The coil 78 in the heat exchanger 72 connects by a line 82 to the reservoir 70. When the screed heating system is not operating the oil in the heat exchanger 72 empties by gravity into the reservoir 70. The heat exchanger 72 may be incorporated in the muffler 76 rather then between the muffler and engine 74**.

The described screed heating system can be used as the primary heating system for the main and/or extender sole plates, and can be used in conjunction with the system described in my copending application Ser. No. 07/847,648.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A heating system for the sole plate of a screed on an asphalt paving machine comprising:

a tractor;

an internal combustion engine on said tractor powering the tractor, said engine having an exhaust system;

a screed coupled to said tractor, said screed having a sole plate;

a first heat exchanger in said exhaust system;

a second heat exchanger on said sole plate; and circulating means for circulating liquid between said heat exchangers and thereby transferring heat from said exhaust system to said sole plate.

2. A heating system according to claim 1 in which said first heat exchanger comprises a coil around an exhaust pipe in said exhaust system of the internal combustion engine.

3. A heating system according to claim 1 in which said circulating means includes a pump taking suction from a reservoir connected to said first heat exchanger, said pump discharging heated liquid under pressure to said second heat exchanger, and said second heat exchanger in turn discharging said liquid for return to said first heat exchanger for reheating after heat transfer in said second heat exchanger.

4. A heating system for the sole plate of a screed on an asphalt paving machine comprising:

a tractor;

an internal combustion engine on said tractor powering the tractor, said engine having an exhaust system;

a screed coupled to said tractor, said screed having a sole plate;

a heat exchanger having a heat exchange tube mounted directly on said sole plate for receiving a heated liquid; and heat transfer means for heating a liquid from heat in said exhaust system and circulating the heated liquid through said heat exchange tube.

5. A heating system according to claim 4 in which said heat transfer means includes a second heat exchanger in said exhaust system and a pump for circulating liquid between said heat exchangers.

6. A heating system according to claim 5 in which said second heat exchanger includes a tube coiled around an exhaust pipe in said exhaust system.

7. A heating system according to claim 5 in which said pump is driven by a hydraulic motor which in turn is driven by pressurized fluid circulated by a second pump driven by said engine.

8. A heating system in an asphalt paving machine comprising:

a tractor;

an internal combustion engine on said tractor powering the tractor, said engine having an exhaust system;

a main screed coupled to said tractor;

extender screeds mounted on said main screed;

sole plates on said screeds;

a first heat exchanger in said exhaust system;

additional heat exchangers on said sole plates of the main screed and extender screeds; and circulating means for circulating liquid between said first heat exchanger and said additional heat exchangers and thereby transferring heat from said exhaust system to said sole plates.

9. A heating system according to claim 8 in which said circulating means includes a circulating pump driven by a hydraulic motor, and a hydraulic circuit including a hydraulic pump driven by said engine and including said hydraulic motor, whereby said circulating pump is powered by energy derived from said engine.

10. A combination heating system and vibratory system for a screed coupled to a tractor on an asphalt paving machine comprising:

a tractor;

a screed coupled to said tractor and having a sole plate;

an internal combustion engine powering said tractor and having an exhaust system including a first heat exchanger for heating circulating liquid by the exhaust heat from the engine;

a screed-heating hydraulic circuit including a second heat exchanger on said screed for heating the sole plate of the screed, and including a circulation pump for circulating heating liquid between said heat exchangers, a hydraulic motor coupled to said circulation pump;

a vibratory unit on the screed driven by a second hydraulic motor;

and a pressurized liquid supply circuit to said hydraulic motors including a primary pump on said tractor driven by said engine.

11. A system according to claim 10 in which said second heat exchanger includes heat exchange tubes in direct engagement with said sole plate, said heating liquid passing through said tubes.

12. A method for heating a sole plate of a screed coupled to a tractor on an asphalt paving machine, said tractor having an internal combustion engine powering the tractor, said method comprising:

transferring heat from the exhaust gases of said engine to a liquid;

circulating the heated liquid to said screed;

and transferring heat from said heated liquid to said sole plate.

13. A method according to claim 12 in which said liquid is continuously circulated in a closed loop system between a first heat exchanger transferring heat from said exhaust gases to said liquid and a second heat exchanger on said sole plate for transferring heat to the sole plate.

* * * * *